US006632298B1

(12) United States Patent
Morita et al.

(10) Patent No.: US 6,632,298 B1
(45) Date of Patent: Oct. 14, 2003

(54) CASTING SLAB FOR SHADOW MASK, METHOD FOR HEAT TREATMENT THEREOF AND MATERIAL FOR SHADOW MASK

(75) Inventors: Syun-ichi Morita, Tokyo (JP); Taizo Sato, Yamaguchi (JP); Jun Agari, Yamaguchi (JP); Tsutomu Omori, Kanagawa (JP); Tatsuya Itoh, Kanagawa (JP); Shigeru Hirata, Kanagawa (JP)

(73) Assignees: Toyo Kohan Co., Ltd., Tokyo (JP); Nippon Yakin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/979,780

(22) PCT Filed: May 24, 2000

(86) PCT No.: PCT/JP00/03323

§ 371 (c)(1),
(2), (4) Date: Feb. 26, 2002

(87) PCT Pub. No.: WO00/72995

PCT Pub. Date: Dec. 7, 2000

(30) Foreign Application Priority Data

May 27, 1999 (JP) ..... 11-148866
Dec. 28, 1999 (JP) ..... 11-375719

(51) Int. Cl.[7] ..... C22C 38/08; C21D 8/00

(52) U.S. Cl. ..... 148/336; 148/541; 148/546; 420/94

(58) Field of Search ..... 148/336, 541, 148/546; 420/94

(56) References Cited

U.S. PATENT DOCUMENTS 5,325,911 A * 7/1994 Tsuda et al.

FOREIGN PATENT DOCUMENTS

JP 5-247756 * 4/1995
JP 11-80839 * 3/1999

* cited by examiner

*Primary Examiner*—Deborah Yee
(74) *Attorney, Agent, or Firm*—Browdy and Neimark, P.L.L.C.

(57) ABSTRACT

The present invention aims at providing a sophisticated segregation reducing technique which a conventional technique cannot achieve by finding the relationship between the casting structure and the segregation of components at the time of solidification and the heat treatment conditions. That is, the present invention aims at providing material for shadow masks which exhibits excellent quality with respect to streaks. A material for a shadow mask of the present invention is formed of a casting slab for preparing the shadow mask which comprises an Ni—Fe alloy containing 30 to 45% of Ni. The casting slab has a cast structure comprising a columnar crystal and/or a chill crystal in an amount of 99% or more. In particular, it is preferred that the casting slab contains no equiaxed crystal. To this end, such casting slab is prepared by a continuous casting method in which casting operation is carried out with no electromagnetic stirring and with maintaining a melt temperature of the non-solidificated part in the slab at a temperature equal to or more than the liquidus thereof. Further, the resultant slab is subjected to a heat treatment at a temperature for a time such that the K value becomes 150 μm or more, to thereby diffuse the segregation of Ni.

16 Claims, 9 Drawing Sheets

THE RELATIONSHIP BETWEEN SLAB Ni SEGREGATION AND QUALITY OF STREAKS

Fig.4

DIFFUSION DISTANCE $K/\mu m=(D \cdot t)^{0.5} \times 10^5$ $D=D_0 \cdot \exp(-Q/RT)$ $D_0=1.63 \times 10^{-4}/m^2 \cdot S^{-1}$ $Q=2.79 \times 10^5/J \cdot mol^{-1}$ $R=8.31/J \cdot mol^{-1} \cdot K^{-1}$ Wherein;

D : Diffusion coefficient [$m^2/S$]

$D_0$: Oscillation frequency term of Ni diffusion obtained by experiment [$m^2/S$]

Q : Activation energy of Ni diffusion obtained by experiment [J/mol]

T : Annealing temperature [K]

t : Annealing time [S]

R : Gas constant [J/mol · K]

RELATIONSHIP BETWEEN SOAKING CONDITION AND Ni SEGREGATION IN SLAB

THE RELATIONSHIP BETWEEN SLAB Ni SEGREGATION AND QUALITY OF STREAKS

THE RELATIONSHIP BETWEEN SLAB SOAKING CONDITION AND QUALITY OF STREAKS

Fig.8

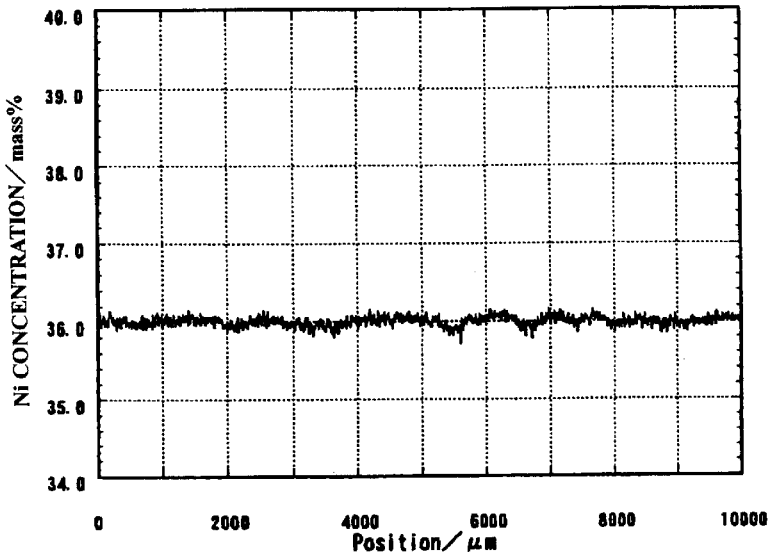

(a)CONTINUOUS CASTING SLAB COMPRISING COLUMNAR CRYSTAL IN AN AMOUNT OF 99 %, Ni SEGREGATION OF CENTRAL PORTION AFTER HEAT TREATMENT AT A TEMPERATURE OF 1300℃ FOR 72 HOURS

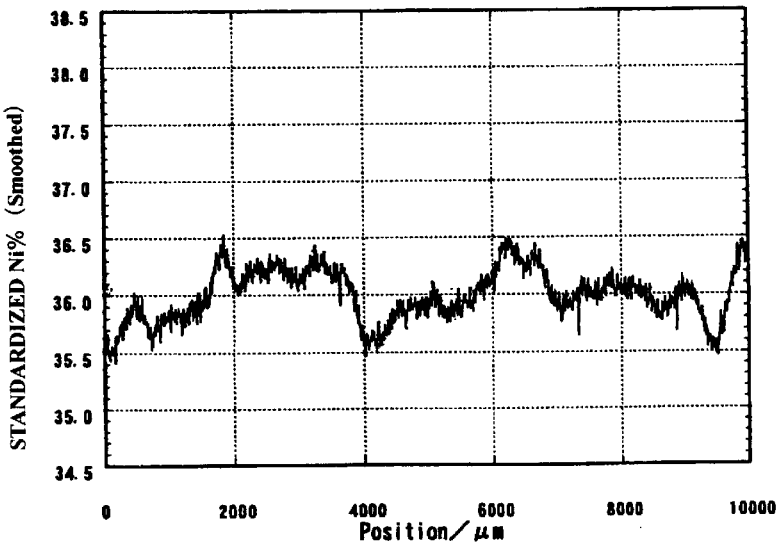

(b)CONTINUOUS CASTING SLAB COMPRISING EQUIAXED CRYSTAL IN AN AMOUNT OF 30 %, Ni SEGREGATION OF CENTRAL PORTION AFTER HEAT TREATMENT AT A TEMPERATURE OF 1300℃ FOR 72 HOURS

DIFFERENCE OF Ni SEGREGATION REDUCTION EFFECT

DUE TO DIFFRENCE OF STRUCTURE OF CONTINUOUS CASTING SLAB

36% Ni SLAB, COLUMNAR CRYSTAL AND CHILL CRYSTAL 100 %

36% Ni SLAB, COLUMNAR CRYSTAL AND CHILL CRYSTAL 55 %

CASTING SLAB FOR SHADOW MASK, METHOD FOR HEAT TREATMENT THEREOF AND MATERIAL FOR SHADOW MASK

The present application is the national stage under 35 U.S.C. 371 of international application PCT/JP00/03323, filed May 24, 2000 which designated the United States, and which international application was not published under PCT Article 21(2) in the English language.

Casting slab for shadow mask, heat treatment method thereof and material for shadow mask.

TECHNICAL FIELD

The present invention relates to a casting slab for shadow mask made of Ni—Fe based alloy which exhibits an excellent streak suppression effect at the time of etching, the heat treatment method thereof and material for shadow mask, and more particularly to a casting slab for shadow mask made of Ni—Fe based alloy which is suitably used as a shadow mask of a color-television cathode ray tube or a computer-display cathode ray tube, the heat treatment method thereof and material for shadow mask.

BACKGROUND OF THE INVENTION

A Ni—Fe alloy (particularly, a Fe-36%Ni alloy) which is known as an Invar alloy and is used as shadow mask material of a large-sized color-television cathode ray tube or a high-definition cathode ray tube for computer display suffers from a drawback that a stripe pattern called "streaks" appears in the direction parallel to the rolling direction when the perforation by etching is performed. The segregation of Ni—Fe which is present in a material sheet served for etching is considered to be a main cause of the generation of the streaks. This segregation is a phenomenon that the solidification segregation which is generated at the time of performing the continuous casting or the ordinary ingot casting with respect to material still remains in a final product sheet even after passing through steps which is a combination of hot working, cold working, annealing and the like after performed by the above-mentioned casting. The segregation at the time of solidification is generated in the state that it is extended in the rolling direction of the coil at the preliminary step and hence, when the product sheet is etched, they become apparent as etching irregularities in stripes parallel to the rolling direction.

Conventionally, there have been proposed several techniques for suppressing the generation of streaks at the time of etching. For example, Japanese Patent No. 2130577 (Japanese Patent Publication 78270/1995) discloses a method which suppresses the generation of streaks by applying the heat treatment above a fixed temperature and a fixed time with respect to a continuous casting slab whose solidification structure is controlled.

Further, Japanese Patent No. 2000062 (Japanese Patent Publication 78270/1995) discloses a method which applies annealing to the casting slab at a high temperature for a long time in the same manner.

Still further, Japanese Patent No. 1950743 (Japanese Patent Publication 68128/1994) discloses a method which suppresses the generation of streaks by performing heat treatment of the slab at a high temperature for a long time exceeding conditions which satisfy the relationship between a fixed temperature and a fixed time irrespective of the difference between the continuous casting and the ordinary ingot casting.

The basic principle of these prior art mainly aims at the prevention of etching irregularities which are present in the inside of the slab due to the heat, treatment at a high temperature for a long time by homogenizing the segregation of Ni, C, Si, Mn, Cr and the like by making use of the thermal diffusion.

Although Japanese Patent no. 2130577 Publication also refers to the solidification structure, what this reference implies resides in the prevention of the influence which the crystalline orientation of the solidification structure affects the crystalline orientation in a product sheet and etching irregularities derived from such crystalline orientation.

However, although in the prior art, the annealing which enables the manufacture of product sheets having sufficient characteristics as shadow masks for color-television cathode ray tubes and computer-display cathode ray tubes at that time has been possible, due to the severe mask etching conditions which become necessary along with the demand for the large-sizing and the high-definition of the computer-display cathode ray tubes in particular these days, the segregation reduction level which can be achieved with the prior art now becomes insufficient to suppress the streaks generated at the time of mask etching and hence, a further reduction of the segregation is requested.

To satisfy such a request, it is an object of the present invention to provide a sophisticated segregation reduction technique, that is, a streak reduction technique which can not be achieved by the prior art by finding out the relationship between the casting structure and the segregation at the time of solidification and the heat treatment condition corresponding to such segregation state which have not been taken into consideration in the prior art.

A first aspect of a casting slab for shadow mask of the present invention is directed to a casting slab for preparing a shadow mask which comprises an Ni—Fe alloy containing 30 to 45% of Ni, wherein the casting slab has a cast structure comprising a columnar crystal and/or a chill crystal in an amount of 99% or more and exhibits the excellent quality with respect to streaks.

Further, a second aspect of the casting slab of the present invention resides in that the casting slab does not contain equiaxed crystal.

A third aspect of the casting slab of the present invention resides in that the casting slab is obtained by using a continuous casting method in which casting operation is carried out with no electromagnetic stirring and with maintaining a melt temperature of the non-solidificated part in the slab to a temperature equal to or above the liquidus thereof.

A heat treatment method of a casting slab for shadow mask of the present invention is characterized in that the above-mentioned casting slab is subjected to a heat treatment at a given temperature and for a given time such that the K value becomes 150 $\mu$m or more.

Shadow mask material of the present invention is characterized in that the material is manufactured through steps including hot rolling, cold rolling and annealing using the above-mentioned casting slab.

BRIEF EXPLANATION OF THE DRAWINGS

FIG. 4 shows a relation equation to obtain the diffusion distance K value.

FIGS. 8*a* and 8*b* are graphs showing the result of measurement of the Ni segregation in the casting slab of the present invention and in the casting slab of a comparison example.

BEST MODE FOR CARRYING OUT THE INVENTION

Figure 1:
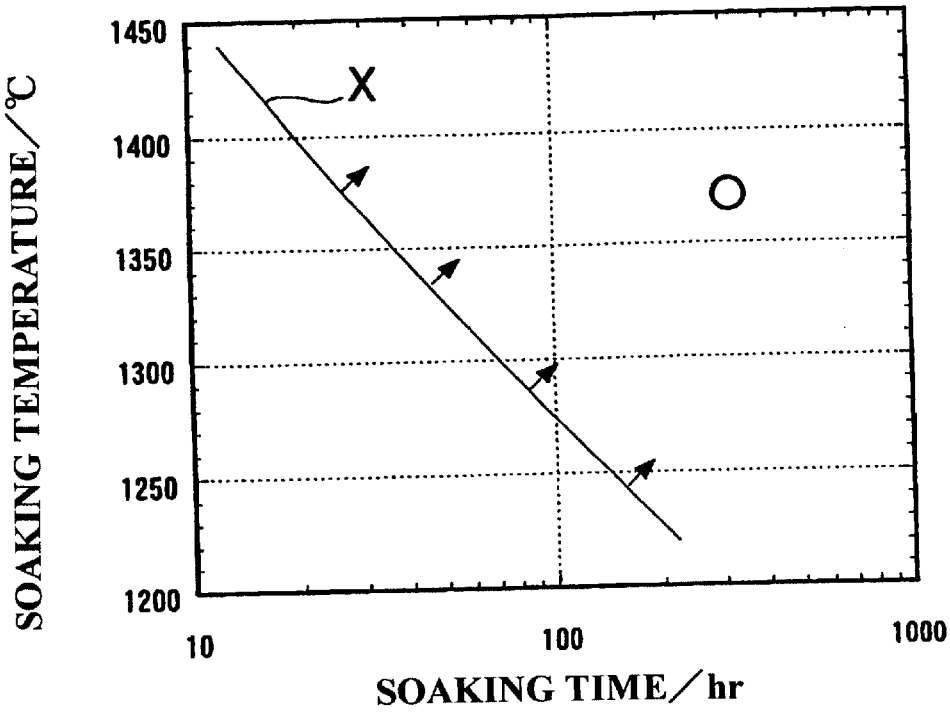
FIG. 1 is a graph showing K values when the soaking condition of a casting slab is changed.

Based on the understanding that a "streaks" defect of a Ni—Fe alloy used as a shadow mask material is mainly caused by the segregation of Ni present in the casting slab, it is preferable that the structure of the casting slab containing this Ni segregation comprises a columnar crystal and/or a chill crystal. When a casting slab whose mode of structure does not comprise a columnar crystal and/or a chill crystal is used as a starting raw material, even when the casting slab is subjected to succeeding steps which are a combination of hot working, cold working, annealing and the like, the segregation of Ni present at the time of casting the slab is not solved so that even when the casting slab is formed into a thin sheet as a final shadow mask material, the segregation appears as an "streaks" defect.

The material which becomes the subject of the present invention is material for shadow mask comprised of Ni—Fe alloy containing 30 to 45% of Ni. In most cases, material called "Invar alloy" which contains 36% of Ni and whose balance is substantially made of Fe is used. Here, the composition of the present invention may contain, for example, constituents such as Nb, Co, Cr or the like which substantially amounts to few % at maximum when necessary. However, these constituents do not influence the effect of the present invention and hence, the present invention includes the material containing these constituents.

The slab for shadow mask of the present invention is restricted to a continuous casting slab which comprises a columnar crystal and/or a chill crystal in an amount of 99% or more, and preferably 100% due to a reason set forth below. That is, in the slab solidification step, when the segregation is reduced due to a thermal diffusion in the preliminary step, the most decisive factor is the interval of the fluctuation of components of the segregation. Based on the general finding that the shorter this interval, the heating temperature necessary for the reduction of the segregation can be lowered or the heating time can be shortened, the relationship between the segregation and the solidification structure of the slab has been focused and has been subjected to the detailed investigation.

As the result of the investigation, it was found that, in the columnar crystal structure or in the chill crystal structure having a similar solidification state with the columnar crystal structure which are generated in the continuous casting slab, the interval between the segregation is extremely short compared with other solidification structure. Further, it was also found that the interval of the segregation in these solidification structures depends on the interval of the primary dendrite arms. Since the segregation derived from the secondary and cubic dendrite arms is dissipated by the heat treatment performed in a relatively short time, they are not taken into consideration specifically in the present invention.

Accordingly, it is desirable that the structure of the slab for shadow mask comprises the columnar crystal structure and/or the chill crystal structure in an amount of 99% or more, and preferably 100%. With respect to the chill crystal structure, since the formation of the structure is limited to a quenching solidification portion which comes into contact with a mold at the time of solidification, the structure is hardly formed and merely amounts to few % of the total volume of an ordinary continuous casting slab.

Although it is preferable to form a portion other than the chill crystal into the columnar crystal, such a formation can be achieved by following operation controls.

First of all, in the operation of the ordinary continuous casting facilities, the casting is performed while stirring the molten steel with an electromagnetic stirring (EMS) to avoid the concentration of the segregation and the generation of the nests at the central portion of the slab. However, in such an operation method, the central portion of the slab does not form the columnar crystal structure but forms the equiaxed crystal structure and hence, the method is not preferable. Accordingly, to obtain the casting slab of the present invention, it is necessary to perform the operation which intentionally stops the EMS so as to suppress the flow of the molten steel in the inside of the continuous casting mold as much as possible. Alternatively, a method which stops the EMS and further suppresses the flow of the molten steel using an electromagnetic brake or the like is also effective. Secondarily, even if there exists no flow of the molten steel, when the temperature of the molten steel in the non-solidified portion in the slab becomes equal to or below the liquidus thereof, the nucleus of the equiaxed crystal is generated and grown in the molten steel and hence, the targeted columnar crystal structure cannot be obtained. Accordingly, it is preferable to perform the operation in the state that the temperature of the molten steel is maintained above the liquidus in the phase diagram. To be more specific, it is preferable to maintain the degree of separation ($\Delta T$) from the liquidus to more than 25° C. The upper limit of $\Delta T$ differs within the range of operation conditions of the individual continuous casting machine and hence, it is unnecessary to specifically define the upper limit in the present invention.

In the present invention, although the upper limit of the heating temperature of the slab is not specifically determined, it is preferable to set the upper limit to a temperature which is 10 degrees below a melting point of the material.

Embodiment

The relationship equation shown in FIG. 4 is a known relationship equation which indicates the diffusion distance that the segregation generated in the slab can be diffused in the slab by the heat treatment of the casting slab performed after the generation of the segregation. By putting values of diffusion activation energy of Ni in this equation (1) and further by putting a typical slab heat treatment time (a soaking time) and a typical heat treatment temperature (a soaking temperature), K values are obtained and are shown in a following Table 1.

TABLE 1

K values when the soaking condition is changed.

| temperature | heat treatment time 36 hr | 48 hr | 60 hr | 72 hr |
|---|---|---|---|---|
| 1280° C. | 93 | 108 | 121 | 132 |
| 1300° C. | 107 | 124 | 138 | 152 |
| 1320° C. | 123 | 142 | 158 | 173 |
| 1340° C. | 140 | 161 | 180 | 198 |

Figure 7:
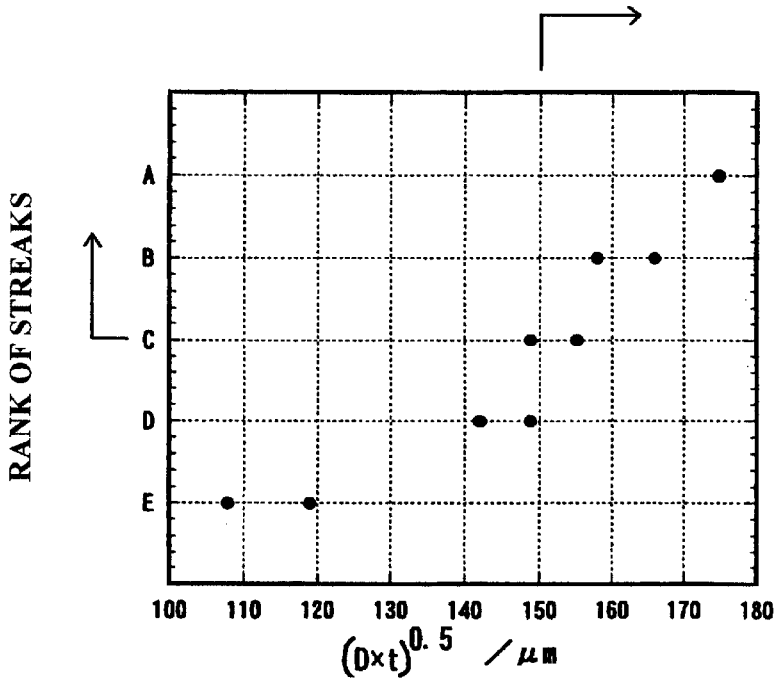
FIG. 7 is a graph showing the relationship between the K value and the rank of streaks.

FIG. 7 is a view which shows the relationship between the K values shown in Table 1 and the rank of streaks. It can be understood as follows from FIG. 7. That is, it is preferable to perform the heat treatment under the condition that the K value becomes equal to or more than 150 μm to obtain the rank C of streaks. It is preferable to perform the heat treatment under the condition that the K value becomes equal to or more than 160 μm to obtain the rank B of streaks. It is preferable to perform the heat treatment under the condition that the K value becomes equal to or more than 170 μm to obtain the rank C of streaks. Here, the rank of streaks means the degree of the streaks which practically brings about no problem when the material is actually formed into a shadow mask at an etching maker of shadow masks.

The rank A indicates a case in which the streaks are not observed at all, the rank E indicates a case in which the streaks are extremely strongly observed, and the rank difference between the rank A and the rank E is divided into 5 stages. It has been found that, as the degree of the streaks, the rank C or more is preferable from the experience and the achievement of conventional materials. Accordingly, it is preferable to produce the shadow mask material of equal to or above the rank C. To this end, inventors of the present invention have investigated the relationship between the streaks and the Ni segregation in the slab.

Figure 6:
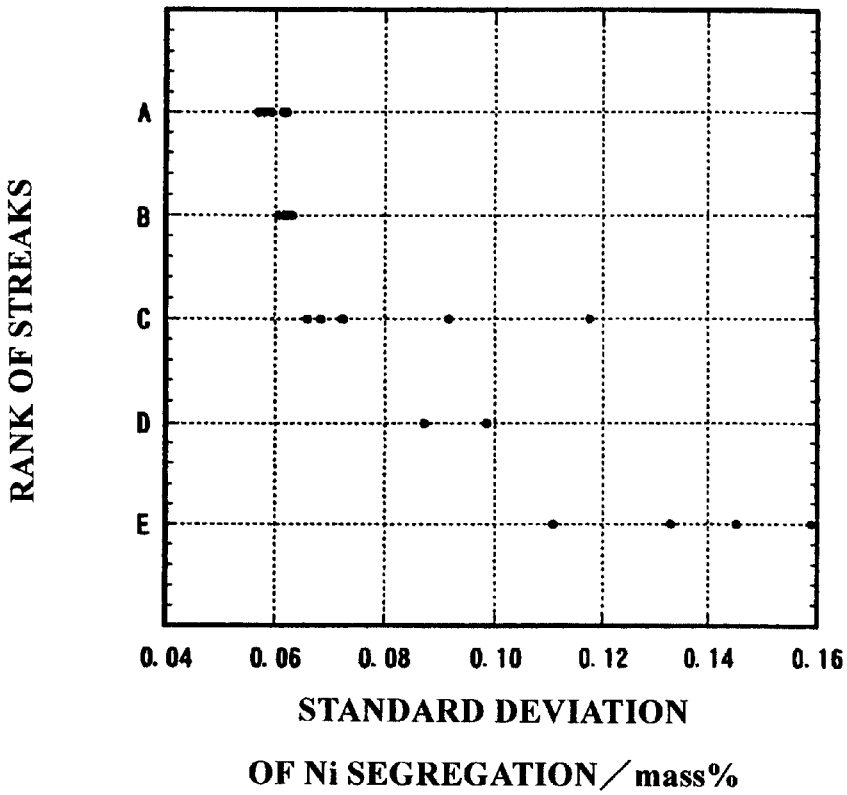
FIG. 6 is a graph showing the relationship between the standard deviation of Ni segregation in a slab and the rank of streaks.

FIG. 6 is a graph showing the relationship between the standard deviation of the Ni segregation of the slab and the rank of streaks. The result shown in FIG. 6 is obtained such that shadow mask materials are produced from materials which differ in the standard deviation of the Ni segregation of the slab by simulating steps up to the plate thickness of the shadow mask material product, the shadow mask materials are etched and the rank of streaks (the strength of streaks) which appear on the etching surface at the time of etching are investigated.

It was found from FIG. 6 that the larger the standard deviation of Ni segregation of slab, the rank of streaks becomes low (the quality is worsened or deteriorated). That is, to raise the rank of streaks to equal to or above the rank C, it is preferable to set the standard deviation of Ni segregation of slab to equal to or less than 0.07 mass %.

Figure 5:
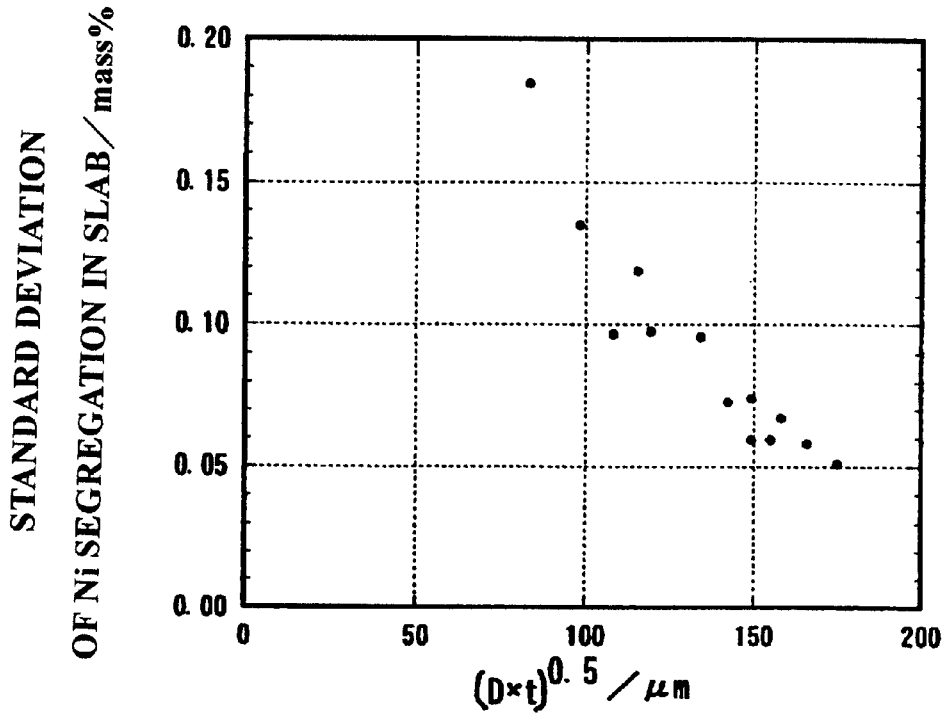
FIG. 5 is a graph showing the relationship between the standard deviation of Ni segregation in slab and the soaking condition of the casting slab.

Then, a method for setting the standard deviation of Ni segregation of slab to equal to or less than 0.07 mass % is considered. FIG. 5 is a graph which shows the result of the method. That is, although it is understood from FIG. 5 that when the heat treatment is performed at a high temperature for along time, the tendency to reduce the Ni segregation is observed, it is also understood from FIG. 5 that it is desirable to set the K value to equal to or more than 150 μm to set the standard deviation of Ni segregation of slab to equal to or less than 0.07 mass %.

FIG. 5 also shows the value that the standard deviation of the Ni segregation of slab takes at a portion of the slab which is located in the vicinity of the center of the slab where the diffusion of the segregation hardly progresses due to the longest interval of Ni segregation after soaking when the slab soaking is performed on the condition that the casting slab shows the K value on the axis of abscissas. Here, "in the vicinity of the center of the slab" means a position which is approximately 3 mm displaced from the center of the slab in the thickness direction and the sampling was performed at this position.

Figure 2:
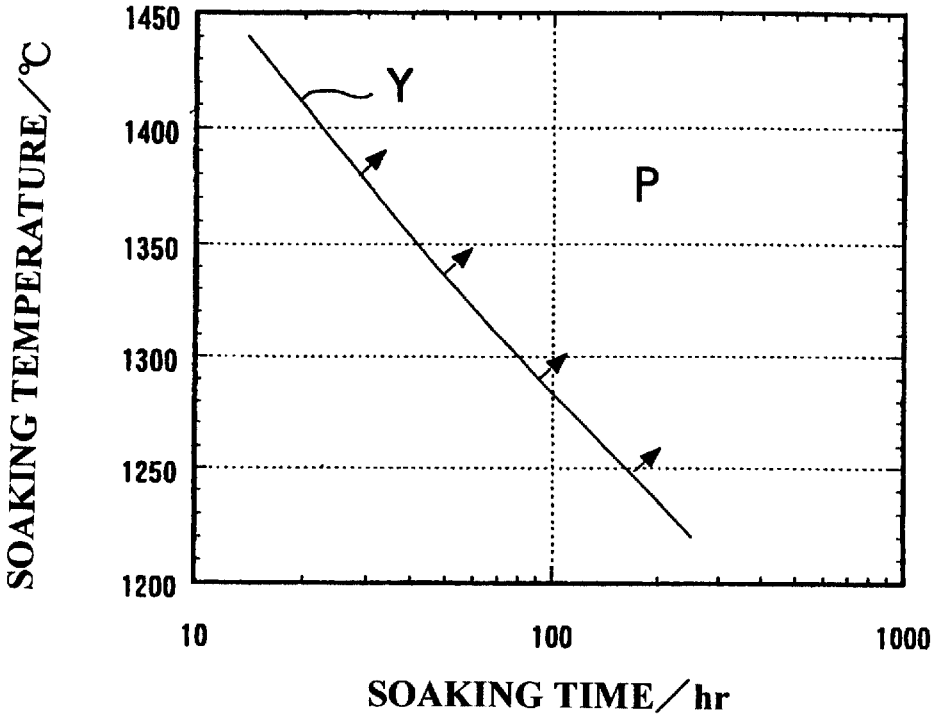
FIG. 2 is a graph showing K values when the soaking condition of a casting slab is changed.
Figure 3:
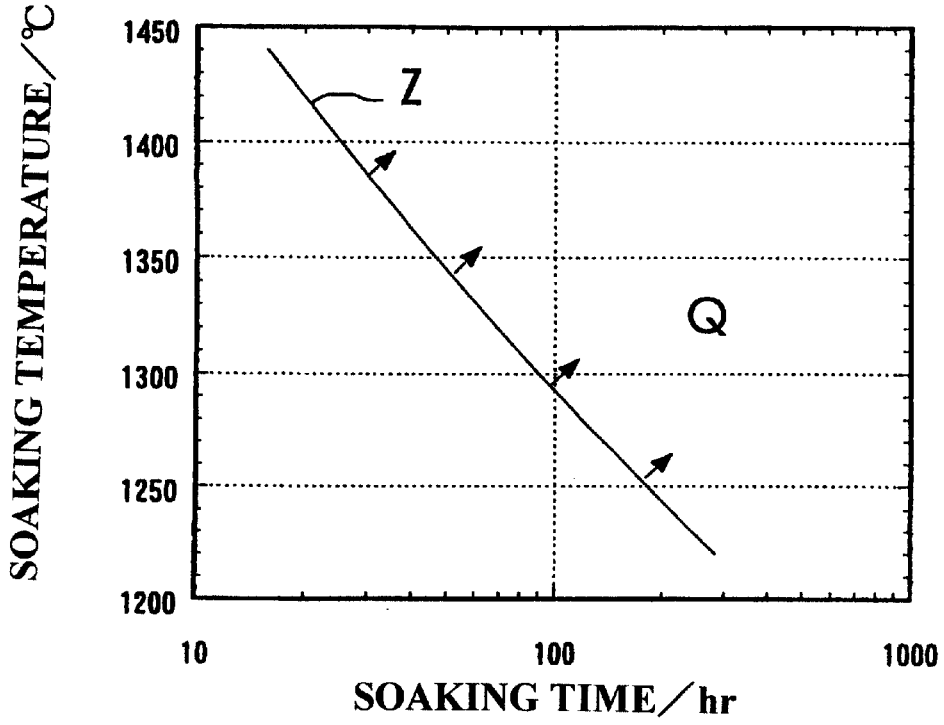
FIG. 3 is a graph showing K values when the soaking condition of a casting slab is changed.

In graphs shown in FIG. 1 to FIG. 3, the change of the slab soaking condition which can set the above-mentioned K value to equal to or above 150 μm is indicated. FIG. 1 to FIG. 3 show that corresponding to the shifting of the soaking condition from X→Y→Z, the diffusion of Ni progresses. That is, to enhance the diffusion of the Ni by performing the heat treatment of the cast slab, it is preferable to perform the heat treatment under the conditions with respect to the time and the temperature of the heat treatment which fall in an area C exceeding an X boundary line of FIG. 1. By performing the heat treatment under the conditions with respect to the time and the temperature of the heat treatment which fall in an area P exceeding a Y boundary line of FIG. 2, the diffusion of Ni can be further enhanced. Further, by performing the heat treatment under the conditions with respect to the time and temperature of the heat treatment which fall in an area Q exceeding a Z boundary line of FIG. 3, the diffusion of Ni can be still further enhanced.

The areas which are respectively indicated by O in FIG. 1, P in FIG. 2 and Q in FIG. 3 show boundary lines which define areas where the K value of the diffusion distance indicated by the relationship equation (1) of FIG. 4 respectively becomes equal to or above 150 μm (corresponding to the O area in FIG. 1), preferably equal to or above 160 μm (corresponding to the P area in FIG. 2) and more preferably equal to or above 170 μm (corresponding to the Q area in FIG. 3).

The Ni segregation used for the evaluation of the material characteristics in the steps of the present invention are all measured and are subjected to the data processing under following conditions.

Measuring apparatus: X-ray microanalyzer JXA-8600MX produced by Nihon Denshi Ltd.

Measuring method: ray analysis

Measuring conditions:

The Ni segregation measuring conditions were set as follows.

| | |
|---|---|
| Prove diameter | 100–3000 nm |
| Irradiation current | $5.0 \times 10^{-7}$ A |
| Acceleration voltage | 20 kV |
| Measuring time | 0.5 sec/point |
| Measuring length | 10 mm |
| Measuring interval | 2 μm |
| Spectral crystal | LiF |

Data processing method: With respect to measuring data of 5000 points obtained under the above-mentioned measuring condition, using the standard deviation of data of 4992 points after taking the three-points moving average four times as the index of the Ni segregation quantity, the standard deviation of Ni segregation in slab is expressed as indicated on the axis of ordinates in FIG. 5.

The shadow mask material is etched by immersing the shadow mask material in a ferric chloride solution of 5 degree of Baume at a room temperature for 20 minutes and the degree of the occurrence of the streaks is expressed by the ranking based on the observation of an etched surface with naked eyes.

Figure 9:
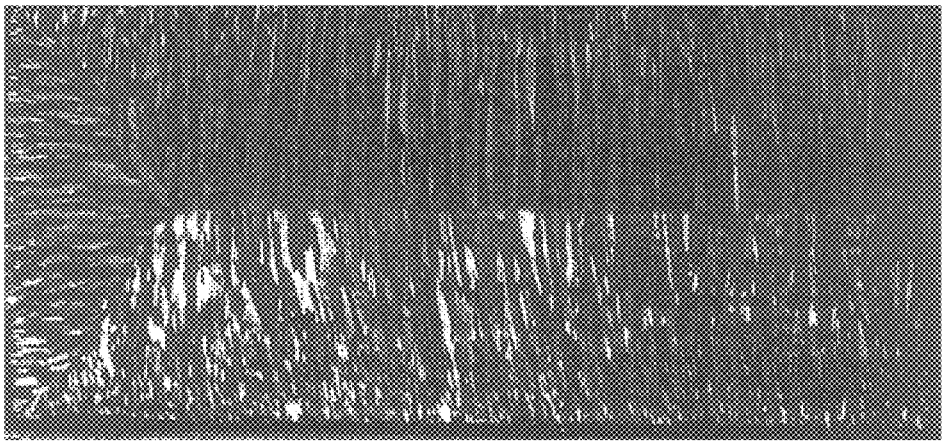
FIG. 9 is a photograph showing the structure of the casting slab of the present invention.
Figure 10:
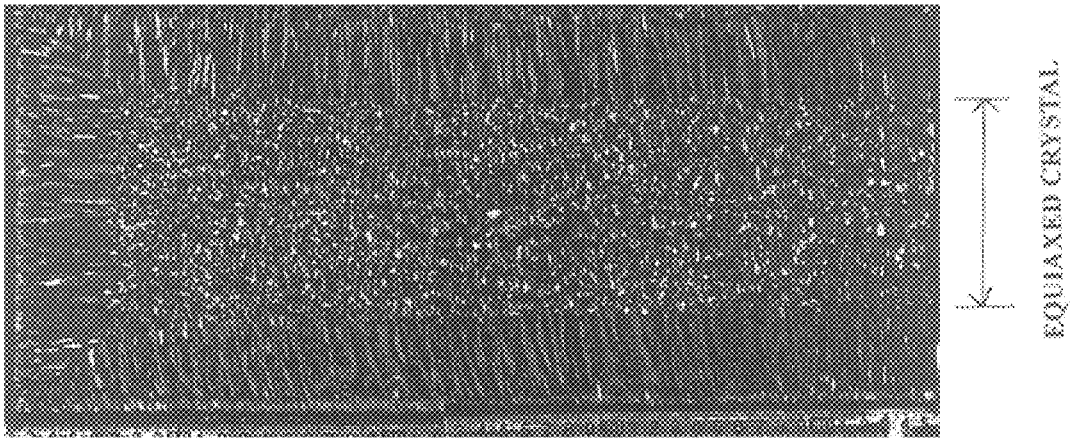
FIG. 10 is a photograph showing the structure of the casting slab of the comparison example.

FIG. 8 shows the result of the measurement of the Ni segregation after performing the heat treatment of a portion of the slab in the vicinity of the center thereof at 1300° C. for 72 hours with respect to the continuous casting slab which comprises the columnar crystal and/or chill crystal in an amount of 99% or more which is the requisite of the present invention and the continuous casting slab which is prepared as a comparison example and forms approximately 30% of equiaxed crystal at the central portion of the slab. In FIG. 8, the measured distance by the ray analysis of the X-ray microanalyzer is taken on the axis of abscissas and the Ni by weight percent is taken on the axis of coordinates. As can be clearly understood from FIG. 8, the period of the Ni segregation in the continuous casting slab comprising the equiaxed crystal is 1000 m–2000 m and hence is 2–4 times longer than that of the continuous casting slab comprising the columnar crystal so that the progress of the reduction of the segregation due to the heat treatment is difficult to achieve. This slab with the equiaxed crystal rate of 30% was subjected to an experimental rolling to produce a thin film sample and the sample was etched. The result of the judgement of streaks was the rank E. Accordingly, it is not appropriate to use the casting slab having the equiaxed crystal structure as the shadow mask material. Further, FIG. 9 shows the structure photograph of the casting slab of the present invention. FIG. 10 shows the structure photograph of the casting slab prepared as a comparison example. The etching condition in these photographs is that the ferric chloride solution (45 Baume/50° C.) was sprayed for etching for one minute. Here, the rate of the casting structure is expressed as the rate of area as viewed on a cross section perpendicular to the casting direction.

In the actual operation, the slab heat treatment condition for obtaining a given K value is selected from Table 1 in view of the ability and the productivity of a heat treatment furnace so that a product sheet having an arbitrary quality of streaks at the time of etching can be produced.

The casting slab is formed into a hot rolled steel plate having a thickness of 2.5 mm and thereafter the steel plate is subjected to nitric acid pickling. It is preferable that the succeeding cold rolling is performed with the working rate in the range of approximately 20–95%, the annealing is performed at a temperature which falls in the range of 700–1000° C. when a continuous furnace is used, and the refining rolling is performed with the working rate set in a range of 1–50%. Thorough these steps, the shadow mask material shaving different sheet thickness within the range of 0.1–0.39 mm were produced. These shadow mask materials were etched and the qualities of streaks was checked. The result shows that the qualities of streaks fall in the areas of the ranks A, B, C shown in FIG. 7.

Industrial Applicability

As has been explained heretofore, the shadow mask materials which use the casting slab for shadow mask of the present invention can exhibit the level of the streaks at a degree which satisfies the conventional requirement of etching makers. Accordingly, it is possible to produce the materials having the quality of streaks which may be varied in compliance with the required quality up to a level served for ultra-definition shadow mask which is completely free from the occurrence of streaks after etching.

What is claimed is:

1. A casting slab for producing a shadow mask comprising a Ni—Fe alloy containing 30–45% of Ni, wherein the casting slab comprises a columnar crystal and/or a chill kcrystal in an amount of 99% or more of the casting structure and a K value equal to or more than 150 μm, thus exhibiting excellent quality with respect to streaks.

2. A casting slab according to claim 1, wherein the casting slab has a K value of at least 170 μm and contains no equiaxed crystal.

3. A casting slab according to claim 1 or 2, wherein the casting slab is obtained using a continuous casting method which performs the operation without an electromagnetic stirring while maintaining the melting temperature of an non-solidification portion in the slab equal to or above a liquidus.

4. A heat treatment method of a casting slab for producing a shadow mask characterized in that the heat treatment is performed at a given temperature and for a given time which can set the K value to equal to or more than 150 μm using the casting slab according to claim 1 or 2.

5. A casting slab according to claim 1 or 2, wherein the casting slab is produced by a continuous casting method.

6. A heat treatment method of a casting slab for producing a shadow mask characterized in that the heat treatment is performed at a given temperature and for a given time which can set the K value to equal to or more than 150 μm using the casting slab according to claim 1 or 2 such that, after the heat treatment, the casting slab exhibits the standard deviation of Ni segregation in a slab of not more than 0.07 mass % and exhibits the excellent quality with respect to streaks.

7. Method for producing shadow mask material characterized in that, after performing the heat treatment method according to claim 4, the casting slab is subjected to hot rolling, cold rolling and annealing so as to produce the shadow mask material exhibiting the excellent quality with respect to streaks.

8. Shadow mask material characterized in that, after performing the heat treatment method according to claim 4, the casting slab is subjected to hot rolling, cold rolling and annealing so as to produce the shadow mask material exhibiting excellent quality with respect to streaks.

9. A continuous casting slab for producing a shadow mask characterized in that the casting slab is subjected to the heat treatment such that the K value becomes equal to or more than 150 μm, the casting slab comprises a Ni—Fe alloy containing 30–45% of Ni, and the casting slab comprises a columnar crystal and/or a chill crystal in an amount of 99% or more of the casting structure thus exhibiting excellent quality with respect to streaks.

10. A continuous casting slab for producing a shadow mask according to claim 9, wherein the continuous casting slab is the casting slab having a K value of at least 170 μm which contains no equiaxed crystal.

11. A continuous casting slab for producing a shadow mask according to claim 9 or 10, wherein the continuous casting slab is subjected to heat treatment without being subjected to blooming and forging.

12. A slab for producing a shadow mask comprising a Ni—Fe alloy containing 30–45% of Ni, wherein the standard deviation of Ni segregation in a slab is set to not more than 0.07 mass % and the slab has a K value of at least 150 μm, thus exhibiting the excellent quality with respect to streaks.

13. A method for producing shadow mask material characterized in that a shadow mask slab which comprises a Ni—Fe alloy containing 30–45% Ni, has a K value of at least 150 μm, and exhibits a standard deviation of Ni segregation on a slab of not more than 0.07 mass % is subjected to hot rolling, cold rolling and annealing thus producing the shadow mask material exhibiting excellent quality with respect to streaks.

14. A method for producing a slab for producing a shadow mask comprising a Ni—Fe alloy containing 30–45% of Ni, wherein a continuous casting slab is subjected to heat treatment at a given temperature and for a given time to set the K value to equal to or more than 150 $\mu$m so that the standard deviation of Ni segregation in the continuous casting slab becomes equal to or less than 0.07 mass % thus exhibiting the excellent quality with respect to streaks.

15. A method for producing shadow mask material comprising a Ni—Fe alloy containing 30–45 % of Ni, wherein, after continuous casting, a heat treatment is performed at a given temperature and for a given time such that the K value becomes equal to or more than 150 $\mu$m so as to make the standard deviation of Ni segregation in the continuous casting slab to equal to or less than 0.07 mass % and thereafter, the continuous casting slab is subjected to hot rolling, cold rolling and annealing thus producing the shadow mask material exhibiting excellent quality with respect to streaks.

16. A heat treatment method of casting slab for producing a shadow mask characterized in that the casting slab according to claim 5 is subjected to the heat treatment which makes the K value equal to or more than 150 $\mu$m.

* * * * *

UNITED STATES PATENT AND TRADEMARK OFFICE

CERTIFICATE OF CORRECTION

PATENT NO. : 6,632,298 B1
APPLICATION NO. : 09/979780
DATED : October 14, 2003
INVENTOR(S) : Morita et al.

It is certified that error appears in the above-identified patent and that said Letters Patent is hereby corrected as shown below:

In the drawings, Sheet 4, Fig. 4, the Diffusion Distance formula should read –K/μm= $(D \cdot t)^{0.5} \times 10^6$– .

Signed and Sealed this

Fifteenth Day of August, 2006

JON W. DUDAS
*Director of the United States Patent and Trademark Office*